US005316445A

United States Patent [19]

Snetting et al.

[11] Patent Number: 5,316,445

[45] Date of Patent: May 31, 1994

[54] PUMPING APPARATUS WITH PISTON SEAL AND CYLINDER REMOVING MEANS

[75] Inventors: Mark E. Snetting, Eden Prairie; Thomas F. Kruzel, Maple Grove; Robert D. Cooper, Jr., Blaine, all of Minn.

[73] Assignee: Wagner Spray Tech Corporation, Minneapolis, Minn.

[21] Appl. No.: 25,986

[22] Filed: Mar. 3, 1993

[51] Int. Cl.[5] ..... F01B 29/00

[52] U.S. Cl. ..... 417/53; 417/234; 417/415; 92/128

[58] Field of Search ..... 417/415, 454, 234, 53; 92/171.1, 128, 170.1, 169.1

[56] References Cited

U.S. PATENT DOCUMENTS

| | | | |
|---|---|---|---|
| 1,528,097 | 3/1925 | Cooper | 92/171.1 |
| 1,768,799 | 7/1930 | Stanley | 92/171.1 |
| 1,977,075 | 10/1934 | Magnuson | 92/128 |
| 2,155,180 | 4/1939 | Caldwell | 92/171.1 |
| 2,483,845 | 10/1949 | Robertson | 92/171.1 |
| 2,701,743 | 2/1955 | Mattingly et al. | 92/171.1 |
| 2,778,315 | 1/1957 | Crookston et al. | 417/454 |
| 3,053,194 | 9/1962 | Webster | 417/454 |
| 3,142,257 | 7/1964 | Schudt | 417/454 |
| 3,216,365 | 11/1965 | Detinger et al. | 92/171.1 |
| 4,016,850 | 4/1977 | Bloemers | 92/171.1 |
| 5,007,276 | 4/1991 | Kadis et al. | 92/86 |
| 5,141,414 | 8/1992 | Pierce et al. | 417/532 |

*Primary Examiner*—Richard A. Bertsch
*Assistant Examiner*—Roland G. McAndrews, Jr.
*Attorney, Agent, or Firm*—Faegre & Benson

[57] ABSTRACT

A user-replaceable pumping chamber for a consumer piston pump has a reciprocating piston seal secured to the end of a piston by a threaded fastener. The chamber further has a smooth-bored cylindrical sleeve surrounding the seal to form a cylindrical wall for the chamber. The seal is retained to the piston by a threaded shoulder screw and washer acting against an O-ring in an end face of the seal. The housing has an aperture providing access to the cylindrical sleeve to permit levering a worn sleeve out of the housing.

5 Claims, 2 Drawing Sheets

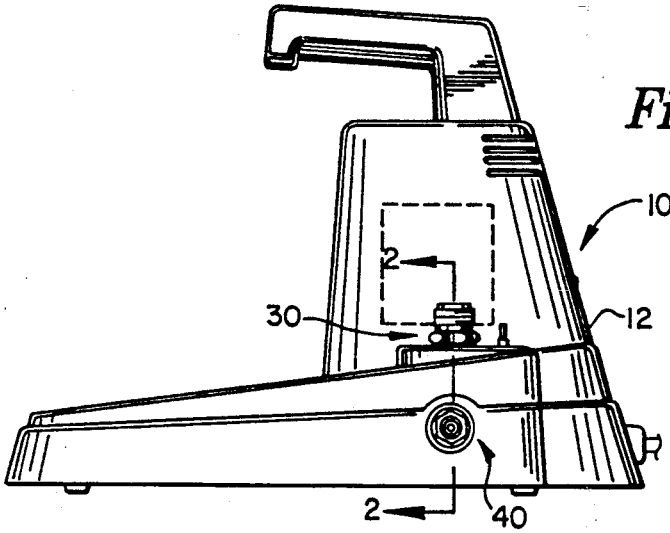
Fig.1
Fig.3
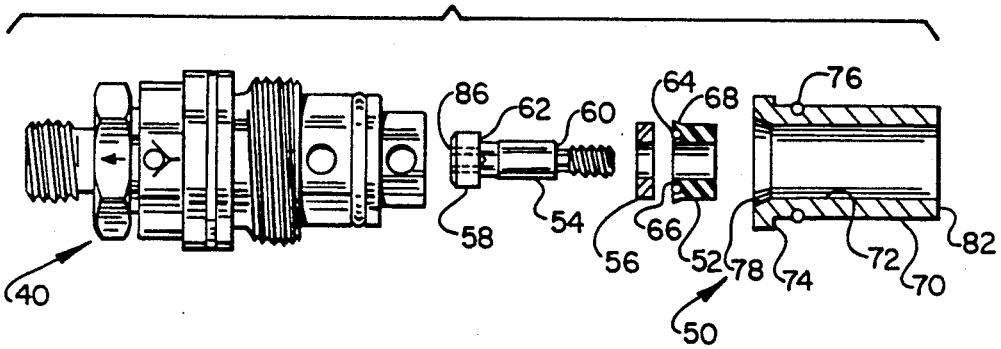
Fig.4
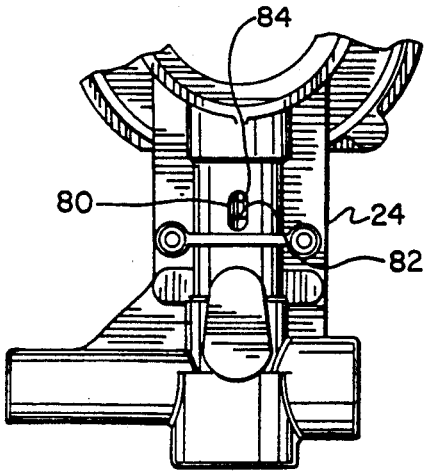

PUMPING APPARATUS WITH PISTON SEAL AND CYLINDER REMOVING MEANS

BACKGROUND OF THE INVENTION

This invention relates to the field of portable spray painting equipment, more particularly to a consumer piston-type pump for airless spray painting.

BRIEF DESCRIPTION OF THE DRAWINGS

FIG. 1 is a side elevation view of a portable spray painting pump housing useful in the practice of the present invention.

FIG. 3 is a an exploded view of the user-replaceable pumping chamber of the present invention.

FIG. 4 is a fragmentary bottom view of a partially disassembled pump housing assembly illustrating a further aspect of the present invention.

DETAILED DESCRIPTION

Figure 2:
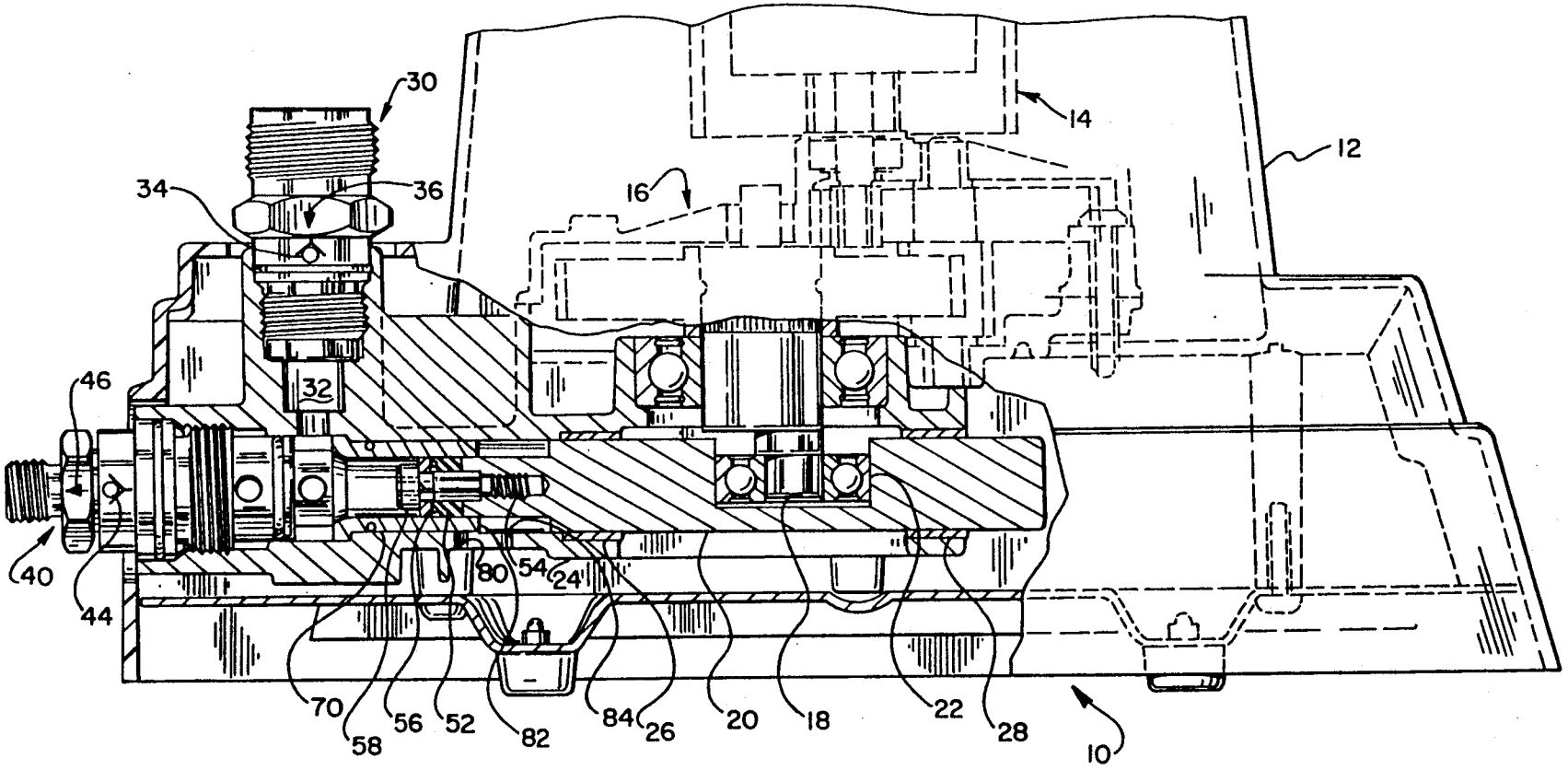
FIG. 2 is a partial section view of the present invention taken along line 2—2 of FIG. 1.

Referring now to the figures, and most particularly to FIG. 1, a portable piston pump 10 useful in the practice of the present invention may be seen. Pump 10 is preferably within an enclosure 12 and is of the reciprocating piston type. Referring now also to FIG. 2, pump 10 has an electric motor 14 acting through a speed-reducing gear train 16 having an output driving an eccentric 18. Eccentric 18 drives a reciprocating piston 20 via an anti-friction bearing 22. Piston 20 is carried in a die-cast pump housing 24 by a pair of bushings 26, 28. An inlet fitting 30 is threaded into an inlet port 32 of housing 24 and preferably contains a check valve indicated schematically by a symbol 34 to allow uni-directional flow indicated by arrow 36. An outlet fitting 40 also includes a check valve internal thereto indicated by symbol 44 to allow flow only in the direction of arrow 46.

Referring now also to FIG. 3, a user-replaceable paint-pumping chamber 50 includes a reciprocating piston seal 52 secured to the end of piston 20 by a threaded fastener 54 which is preferably a shoulder screw. A rigid washer 56 preferably formed of metal is preferably located between a head 58 of fastener 54 and seal 52. As may be seen most clearly in FIG. 2, fastener 54 secures seal 52 against piston 20 via washer 56. Fastener 54 preferably has a closely controlled predetermined distance between shoulder 60 and a compression face 62 of head 58 to provide a predetermined amount of compression of seal 52. Seal 52 itself is a cup type seal formed of urethane and preferably further has an O-ring 64 received in a groove in an end 66 of seal 52. O-ring 64 urges a portion 68 of seal 52 radially outward. Chamber 50 further includes a cylindrical sleeve 70 having a smooth bore 72 there through to form a cylindrical wall of the pumping chamber 50. Sleeve 70 is slidably received in housing 24 and is retained therein by the outlet fitting or check valve 40 acting as a closure member for chamber 50. A radially-extending flange or shoulder 74 positions sleeve 70 in housing 24. Sleeve 70 preferably has an O-ring 76 located in a groove in an outer surface thereof for sealing sleeve 70 to housing 24. Bore 72 preferably has a chamfer 78 radially inward of flange 74 to assist in assembly of the replaceable pumping chamber, particularly aiding the installation of seal 52. Bore 72 preferably has a surface of hard chrome plating thereon. It is to be understood that sleeve 70 is preferably formed of steel, but may alternatively be made of ceramic or even ultra-high molecular weight polyethylene material.

Referring now most particularly to FIGS. 4 and 2, in order to provide easy removal of sleeve 70 from housing 24, an aperture 80 is provided in housing 24. As may be seen most clearly in FIG. 4, a first end 82 of sleeve 70 is visible and accessible through aperture or slot 80. After closure member 40 is removed from housing 24, sleeve 70 may be moved axially away from piston 20 by using a lever between end 82 of sleeve 70 and an opposing surface 84 in aperture 80 of housing 24 until the sleeve 70 is moved axially away from the piston 20 a distance sufficient to disengage O-ring 64 from between the sleeve 70 and housing 24, thus releasing sleeve 70 from housing 24. The aperture 80 is also designed to allow any paint that leaks past seal 52 to exit housing 24 through aperture 80 rather than progressing along piston 20 and contaminating eccentric 18 and gear train 16.

In the event that the user desires to replace either part or all of a worn pumping chamber, closure member 40 located at an end of the pump assembly distal of the piston 20 is removed to provide access to the pumping chamber 50. This provides access to the seal and sleeve of the pumping chamber. The old seal may be replaced alone or in combination with the old sleeve (or the old sleeve may be replaced by itself, while the old seal is removed, but not replaced. If the seal is to be removed (either alone or in combination with the sleeve), the old seal 52 is detached from the end of piston 20 by inserting an Allen wrench or key into a hexagonal recess 86 in head 58 of fastener 54. Fastener 54 may be unthreaded from piston 20, thus permitting withdrawal of seal 52 out of the pump assembly through the axial access. When a worn seal 52 is to be removed, it has been found that removal of the fastener will draw the seal out since there is ordinarily greater wear (and thus less friction) at the outer circumference of the seal than between the worn seal and the fastener because the interface between the seal and the sleeve is a dynamic seal, while the interface between the seal and the fastener is static. If, in addition to replacing a worn seal, it is desired to replace the sleeve, removing an old sleeve 70 may be accomplished easily by moving the sleeve axially away from the piston 20 and out of the pump assembly through the axial access left by removal of closure 40. A new cylindrical sleeve 70 may be inserted into the pump assembly through the axial access by moving the sleeve axially toward piston 20, thus providing a new cylindrical sidewall for the pumping chamber. A new seal 52 may be installed by axially moving the seal into the cylindrical sleeve 70 then in housing 24 and attaching the seal to the piston via fastener 54 and washer 56 using an Allen key or other suitable tool appropriate for fastener 54. Finally, the closure member 40 is reinserted at the end of the pump assembly distal of the piston to close the axial access to the pumping chamber.

The invention is not to be taken as limited to all of the details thereof as modifications and variations thereof may be made without departing from the spirit or scope of the invention.

What is claimed is:

1. A method of replacing a pumping chamber in a cylindrical piston type paint pump assembly comprising the steps of:

a) removing a closure member at an end of the pump assembly distal of a piston in the assembly to provide an axial access to the pumping chamber;

b) removing an old pumping chamber by:

i) detaching an old seal from the end of the piston and withdrawing the old seal out of the pump assembly through the axial access, and ii) removing an old cylindrical sleeve which formed a cylindrical sidewall of the pumping chamber by levering the old cylindrical sleeve against a housing of the pump assembly in a direction away from the piston and out of the pump assembly through the axial access;

c) installing a new pumping chamber into pump assembly by:

i) inserting a new cylindrical sleeve into pump assembly through the axial access by moving the new cylindrical sleeve axially toward the piston to provide a new cylindrical sidewall for the pumping chamber, ii) inserting a new seal through the axial access, iii) axially moving the new seal into the new cylindrical sleeve, and iv) attaching the new seal to the piston; and d) reinserting the closure member at the end of the pump assembly distal of the piston to close the axial access to the pumping chamber.

2. The method of claim 1 wherein step a) further comprises unthreading the closure member from a housing of the pump assembly.

3. The method of claim 1 wherein substep i) of step b) further comprises unthreading a fastener from the piston to release the old seal from the piston.

4. The method of claim 1 wherein the housing further comprises an aperture adjacent an end of the old cylindrical sleeve proximal to the piston and substep ii) of step b) further comprises levering the end of the old cylindrical sleeve against an edge of the aperture in the housing to release the old cylindrical sleeve from the housing.

5. The method of claim 4 wherein the old cylindrical sleeve is sealed to the housing by an O-ring between the old cylindrical sleeve and the housing and substep ii) of step b) further comprises releasing the old cylindrical sleeve from the housing by moving the old cylindrical sleeve away from the piston a distance sufficient to disengage the O-ring from between the old cylindrical sleeve and the housing.

* * * * *